US006364147B1

(12) United States Patent
Meinzinger et al.

(10) Patent No.: US 6,364,147 B1
(45) Date of Patent: Apr. 2, 2002

(54) WASTE CAN WITH CONCEALED WASTE BAG AND SWING-OPEN LID

(75) Inventors: Mathias Meinzinger, Brookville; George Schmidt, Douglaston; Dwayne Hines, Mincola, all of NY (US)

(73) Assignee: Creative Bath Products, INC, Central Islip, NY (US)

( * ) Notice: Subject to any disclaimer, the term of this patent is extended or adjusted under 35 U.S.C. 154(b) by 0 days.

(21) Appl. No.: 09/849,727

(22) Filed: May 4, 2001

(51) Int. Cl.[7] ..... B65F 1/08

(52) U.S. Cl. ..... 220/495.06; 220/908.1; 220/495.05; 220/23.87; 126/243

(58) Field of Search ..... 220/825, 828, 220/833, 836, 908.3, 908, 495.11, 495.08, 495.06, 495.05, 23.83, 23.86, 23.87, 23.91, 908.1; 126/243

(56) References Cited

U.S. PATENT DOCUMENTS

| | | | | |
|---|---|---|---|---|
| 1,988,318 A | * | 1/1935 | King | 220/825 |
| 2,994,453 A | * | 8/1961 | Gardiner | 220/825 |
| 3,083,859 A | * | 4/1963 | Gardiner | 220/825 |
| 3,342,368 A | * | 9/1967 | Matry | 220/825 |
| 4,212,407 A | | 7/1980 | Lydon | |
| 4,679,700 A | | 7/1987 | Tharrington et al. | |
| 4,776,478 A | | 10/1988 | Miller et al. | |
| 4,961,514 A | | 10/1990 | Palmer | |
| 5,183,175 A | | 2/1993 | Brown | |
| 5,219,085 A | | 6/1993 | Craft et al. | |
| 5,292,023 A | | 3/1994 | Yen | |
| 5,295,607 A | | 3/1994 | Chang | |
| 5,381,921 A | | 1/1995 | Bray et al. | |
| 5,387,735 A | | 2/1995 | Ponsi et al. | |
| 5,494,186 A | | 2/1996 | Marsh | |
| 5,588,358 A | | 12/1996 | Klepacki et al. | |
| 5,651,231 A | | 7/1997 | Garland | |

* cited by examiner

*Primary Examiner*—Stephen Castellano
(74) *Attorney, Agent, or Firm*—Anthony J. Casella; Gerald E. Hespos

(57) ABSTRACT

A waste container assembly is provided. The assembly includes an inner can with a closed bottom and an open top. A waste can liner can be placed in the inner can and the free edge of the liner can be folded over the open top of the inner can. The assembly further includes an outer enclosure that is telescoped around the inner can to conceal the inner can, the waste can liner and the contents of the waste can liner. For smaller cans, the outer enclosure has a unitary peripheral skirt and cover that can be telescoped over the inner can. Larger assemblies may have a separate cover and peripheral skirt. A lid is hinged to the cover and can be opened by a slight downward force on an inner portion of the lid. However, the lid is gravitationally biased to return to a closed condition.

6 Claims, 10 Drawing Sheets

32
80
74
78
62
12
66
52
28
76
86
26
38
10
46
42
60
64
50
48
54
44
14
36
24
34
30

WASTE CAN WITH CONCEALED WASTE BAG AND SWING-OPEN LID

BACKGROUND OF THE INVENTION

1. Field of the Invention

The invention relates generally to waste cans, and specifically to a waste can that conceals the waste can liner and any waste therein.

2. Description of the Related Art

The prior art includes many waste cans with a bottom wall, an upstanding side wall enclosure and an open top. The side wall enclosure of prior art waste cans have been provided in many cross-sectional shapes, including, circular and elliptical. Many waste cans are used at locations where they are readily visible. Hence, there is a desire to make waste cans aesthetically attractive.

Most people protect the interior of the waste can from stains or other damage by employing a waste can liner. Waste can liners are plastic bags dimensioned to occupy a volume greater than the volume of the waste can. Thus, the plastic waste can liner is placed in the waste can and top edges of the liner are folded over the side wall of the waste can adjacent the open top. The liner protects the interior of the waste can from stains or damage with sufficient effectiveness. However, the contents of the waste can normally are not concealed by the liner. Furthermore, the hanging edges of the bag-like liner are unattractive and conceal attractive features and/or colors that may have been designed into the can. Additionally, the plastic liners often collapse into the waste can, and trash deposited after such a collapse is likely to be trapped between the liner and the waste can.

Many prior art waste cans include a cover. The cover often is locked to the side wall of the waste can adjacent the open top to prevent inadvertent separation. This feature provides security, but complicates access to the interior of the waste can for replacing a filled liner with an empty liner. Many such covered waste cans place the cover over the upper ends of the side walls after the liner has been placed in the open-top. Thus, the cover is effective for sealing the contents of the waste can but still shows the unattractive free edges of the plastic waste can liner.

Many covered waste cans include a hinged lid in the cover. The hinged lid is intended to facilitate placement of waste into the can. However, covers that include a lift-up lid are inconvenient. More particularly, consumers would prefer to merely throw or otherwise move the trash downwardly into the trash can without the separate step of first lifting the lid upwardly. Waste cans with lids incorporated into the covers typically do not solve the problem of peripheral regions of the waste can liner hanging over the top edge of the waste can and below the attached cover (see U.S. Pat. No. 5,295,605 and U.S. Pat. No. 5,651,231).

The prior art includes waste can systems where an inner trash-receiving can is disposed within an outer can assembly. For example, U.S. Pat. No. 5,183,175 shows a simple cylindrical open-topped inner can mounted in and extending partly above a cross-sectionally larger cylindrical open-topped outer can. A cover with a lid then is telescoped over the open tops of the inner and outer cans. The patent does not show how or whether plastic bags would be used with the disclosed waste can system. However, the close proximity of the telescoping edges of the inner and outer cans and the cover would suggest that any waste can liner would be folded over the top of both the inner and outer cans. Any other arrangement would require the user to manually lift the inner can out of the outer can, fold the top edges of the plastic bag into place and then carefully position overhanging portions of the plastic waste can liner into the narrow space between the inner and outer cans.

U.S. Pat. No. 4,961,514 shows an even more complex assembly that has an inner can positioned on a short base. A long cover then is telescoped over virtually all of the inner can and is locked into engagement with the base. The cover includes an opening to access the interior of the inner can but has no lid for closing the cover. This arrangement presumably would conceal any plastic liner used with the system. However, the contents of the liner could be readily viewed through the opening.

In view of the above, it is an object of the subject invention to provide a waste container assembly that conceals the contents of the assembly.

Another object of the subject invention is to provide a waste container assembly that conceals all portions of the waste can liner that is placed in the assembly for receiving the waste.

An additional object of the subject invention is to provide a waste container assembly that prevents the waste can liner from falling into the waste container.

A further object of the subject invention is to provide a waste container assembly with a hinged cover that facilitates deposit of trash into the waste can liner.

Still another object of the subject invention is to provide a hinged lid on a waste container assembly that facilitates depositing of trash into the assembly without lifting the lid and that enables closure of the lid without springs or other stored energy devices.

SUMMARY OF THE INVENTION

The subject invention is directed to a waste container assembly that comprises an inner can having a bottom wall, an upstanding side wall enclosure and an open top. The bottom wall of the inner can and the open top of the side wall may define identical or similar shapes. However, the open top of the side wall may be slightly larger than the bottom wall in view of molding efficiencies. The bottom wall and the open top edge of the side wall may be any convenient and desired shape. However, a substantially oval shape is preferred in view of aesthetics and functionality of the assembly as described further herein.

The waste container assembly further includes an outer enclosure for substantially completely concealing the inner can and the contents of the inner can. The outer enclosure comprises a peripheral skirt with an open bottom and a top. The open bottom of the peripheral skirt is disposed at or near the closed bottom of the inner can when the outer enclosure is assembled with the inner can. In certain embodiments, the peripheral skirt is dimensioned to terminate a short distance from the floor or other supporting surface for the waste container assembly. In other embodiments, the peripheral skirt extends entirely to the floor.

The outer enclosure further includes a cover that extends upwardly from the peripheral skirt and covers the open top of the inner can. The cover may be unitarily formed with the top end of the peripheral skirt. Alternatively, the cover may be formed separately from the peripheral skirt and may telescope over the top ends of the peripheral skirt and the inner can. This latter embodiment is particularly effective for dimensionally large waste container assemblies and avoids the need to lift a large outer enclosure for removing a full plastic trash can liner and inserting a new trash can liner.

The cover is provided with a hinged lid for accessing the interior of the inner can. The hinged lid extends from a peripheral side region of the outer enclosure to a location spaced inwardly from the side walls. A hinge for the lid is intermediate these inner and outer extremes of the lid. More particularly, the hinge and the lid are configured such that inner portions of the lid can be rotated downwardly for depositing trash into the trash receptacle assembly. However, the lid is configured and the hinge is disposed such that the lid is gravitationally biased toward a closed position. Thus, the lid can be open by urging the inner portion of the lid downwardly. These forces can be generated by hand or by the weight of the object that is being discarded. Upon release of those forces, however, the lid will swing gravitationally back to the closed position. Thus, both the opening of the lid and the closing of the lid are assisted by gravity, and the lid functions much in the manner of a seesaw that is slightly biased in one direction. Either a manual force or a force due to the weight of the trash will overcome the slight gravitational bias toward the closed position and will swing the lid into the open position for gravitationally depositing trash into the inner can of the assembly. The lid then will pivot back toward the closed position due to the forces of gravity and the relative position of the hinge. Thus, neither the opening nor the closing of the lid require any forces by the user other than the forces for depositing the trash into the receptacle.

The inner can is intended for use with a plastic waste can liner. More particularly, the closed end of the plastic waste can liner is placed in the inner can and the open top edges of the plastic waste can liner are folded slightly over the open top of the inner can. The open top of the inner can preferably is provided with a plurality of V-shaped notches. Edge regions of the plastic waste can liner can be bunched together and urged into one or more of the V-shaped notches to facilitate retention of the top edge of the liner in proximity to the open top of the inner can. Thus, the problematic collapsing of the liner into the can is completely avoided. Edge regions of the can are concealed by the outer enclosure. Thus, the user would not see the unattractive free edge of the trash can liner at any time other than when the liner is being removed and replaced.

The cover of the outer enclosure may comprise a substantially downwardly and rearwardly slanted portion and an upwardly and rearwardly slanted portion that intersect. The lid may be disposed on the downwardly and rearwardly slanted portion, and the upwardly and rearwardly slanted portion may include an opening. The intersection of these slanted surfaces provides an efficient target for a user. Thus, a user is likely to deposit trash near the intersection, and hence at a location on the cover that applies a maximum moment to the cover. This moment ensures sufficient forces to overcome the gravitational bias of the cover toward the closed position. Additionally, the proximity of the lid to the opening in the upwardly and rearwardly slanted portion of the cover facilitates accommodation of relatively large items of trash. Additionally, these intersecting surfaces at the upper end of a generally cylindrical or prismatic structure provides an aesthetically attractive appearance.

DETAILED DESCRIPTION OF THE PREFERRED EMBODIMENTS

Figure 1:
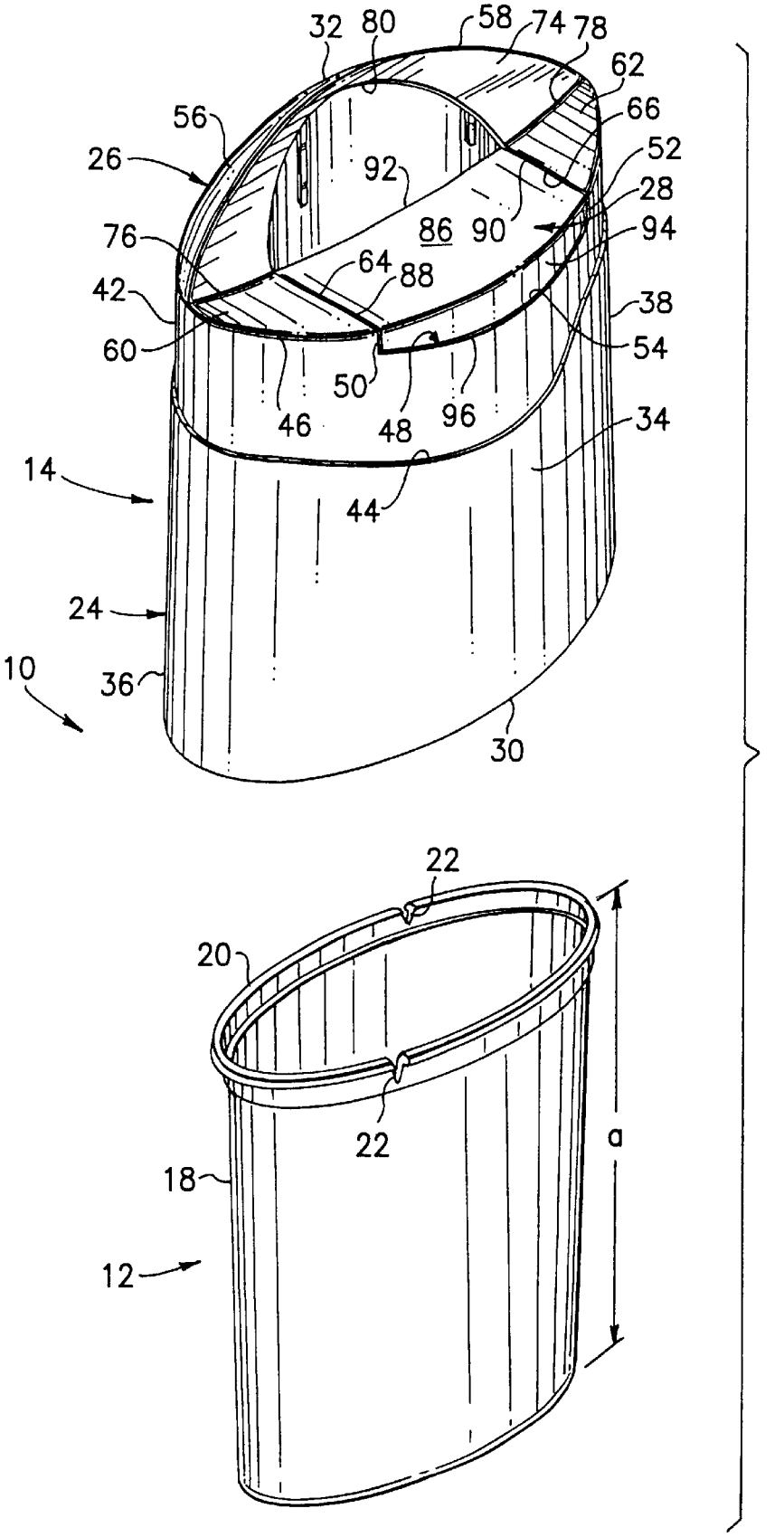
FIG. 1 is an exploded perspective view of a trash can assembly in accordance with a first embodiment of the invention.
Figure 2:
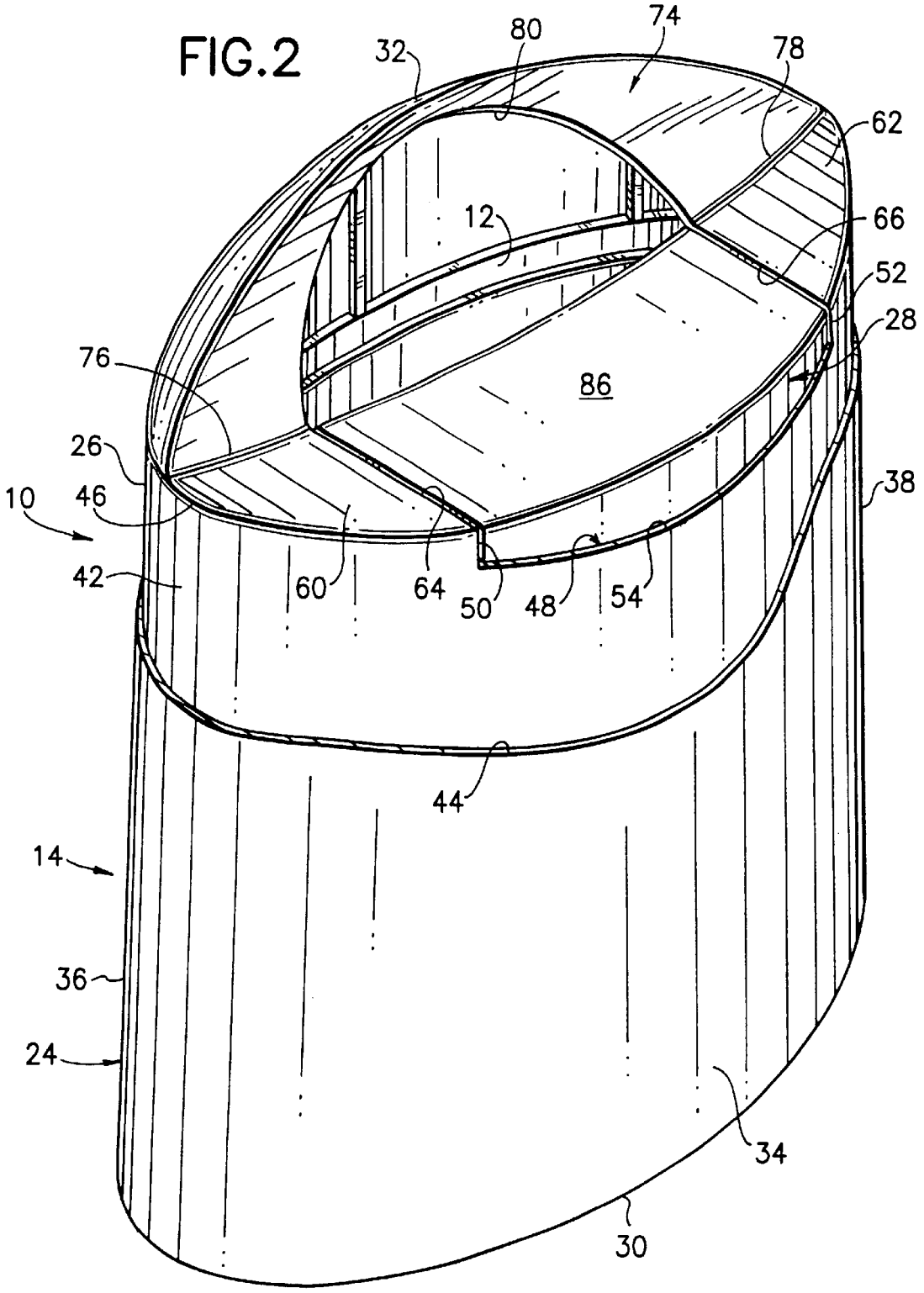
FIG. 2 is a perspective view of the trash can assembly of FIG. 1 in its assembled condition.
Figure 3:
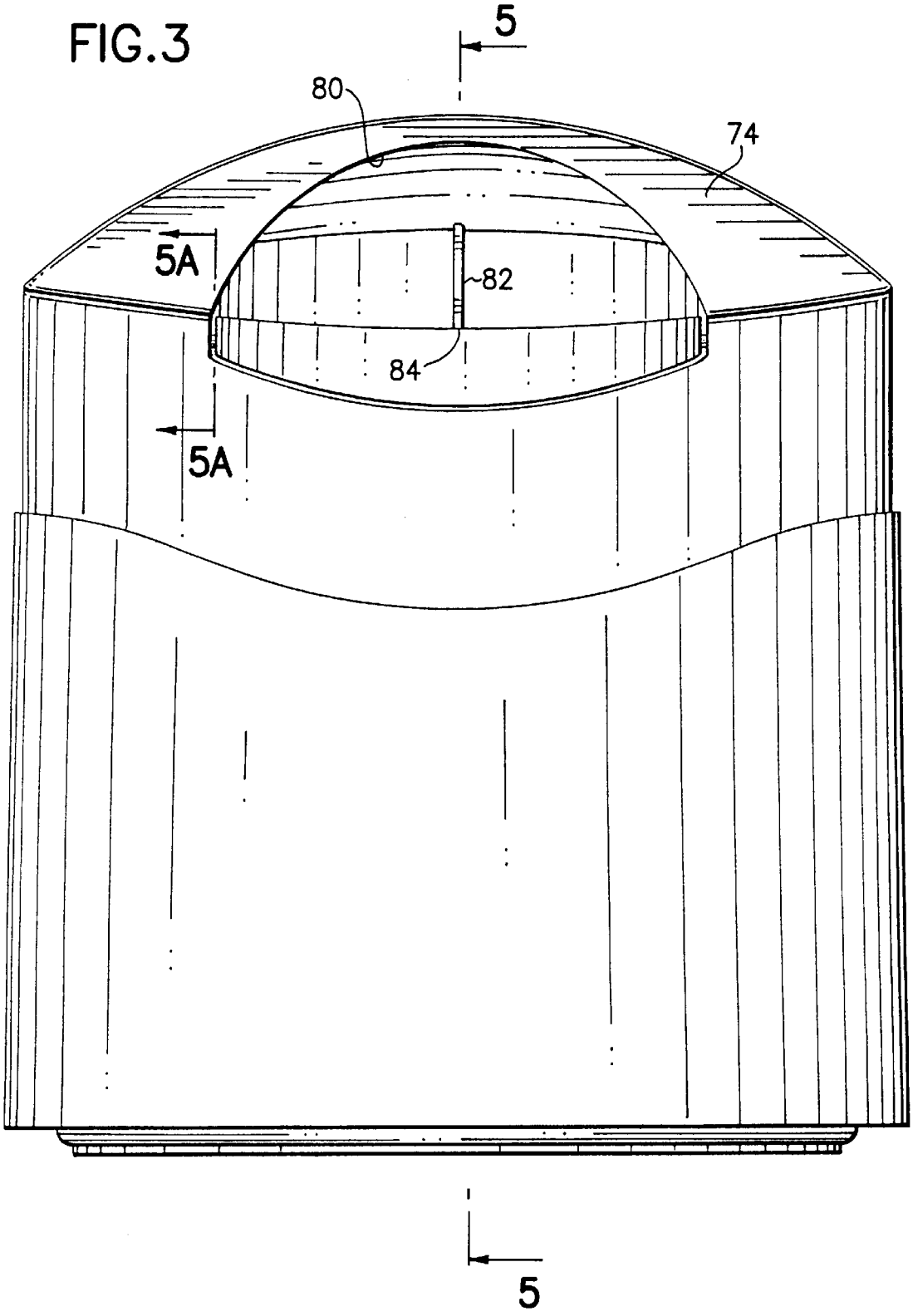
FIG. 3 is a front elevational view of the trash can assembly shown in FIG. 2.
Figure 4:
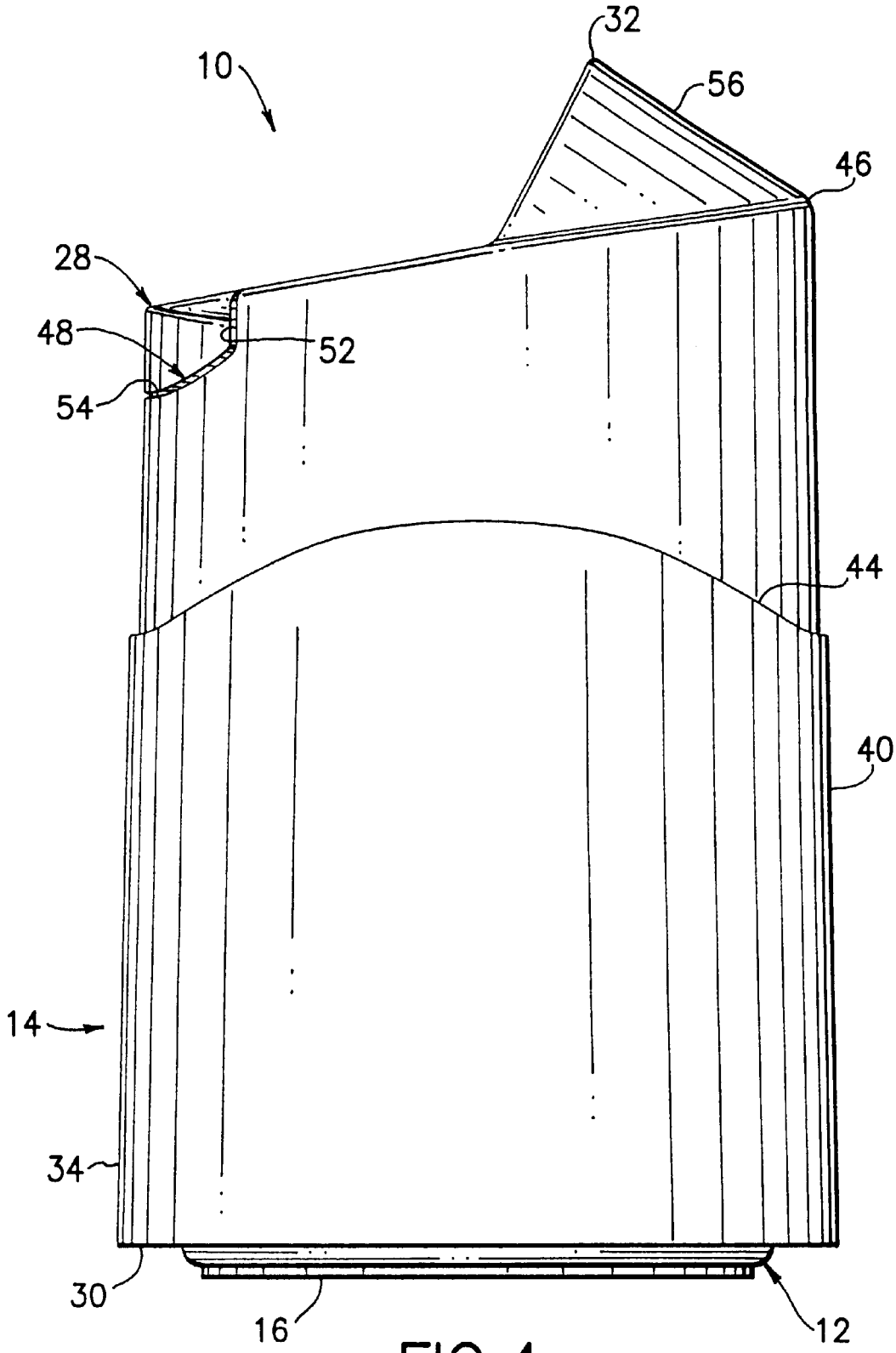
FIG. 4 is a side elevational view of the trash can assembly shown in FIGS. 2 and 3 as viewed from the right side.

A waste container assembly in accordance with a first embodiment of the invention is identified generally by the numeral 10 in FIGS. 1–6. The waste container assembly 10 includes an inner can 12 and an outer enclosure 14.

The inner can 12 is molded unitarily from plastic and includes an oval bottom wall 16. A side wall enclosure 18 extends up from the bottom wall 16 to define an external height "a" for the inner can 12. The side wall enclosure 18 has an oval top edge 20 with a plurality of V-shaped notches 22 extending a short distance toward the bottom wall 16. The notches 22 are dimensioned to releasably grip portions of a waste can liner in proximity to the free edges of the waste can liner as explained further below.

The outer enclosure 14 in accordance with the first embodiment comprises a peripheral skirt 24 and a cover 26 that are unitary with one another and molded from plastic. The outer enclosure 14 further includes a lid 28 that is hingedly mounted to the cover 26 of the outer enclosure 14, as explained below.

The peripheral skirt 24 is of generally oval tubular shape with an open bottom 30 and a cross-sectional configuration to permit the outer enclosure 14 to be telescoped over the inner can 12. The cover 26 of the outer enclosure 14 has a top 32 at an end of the outer enclosure 14 remote from the open bottom 30. The outer enclosure 14 further includes a front 34, opposed left and right sides 36 and 38 and a rear 40. As explained further below, the front 34 defines the portion of the outer enclosure 14 that will face a user who is depositing trash in the waste container assembly 10.

The cover 26 of the outer enclosure 14 includes an oval tubular side wall 42 that extends upwardly from the peripheral skirt 26. However, the side wall 42 of the cover 26 is cross-sectionally slightly smaller than the peripheral skirt 24. Hence, a step 44 is defined between the peripheral skirt 24 and the side wall 42 of the cover portion 26. The boundary 44 is of generally sinusoidal shape around the circumference of outer enclosure 14, as shown most clearly in FIG. 3. A valley of the sinusoidal step 44 aligns symmetrically with the lid 28 on the front 34 of the outer enclosure 14. The step 44 is provided primarily for aesthetic purposes. However, the valley of the step 44 that is symmetrically aligned with the lid 28 helps to focus the user on the section of the waste container assembly 10 to which waste will be deposited.

The side wall 42 of the cover 26 includes a top edge 46 that effectively defines a plane aligned at an acute angle to a vertical axis through the side wall 42. More particularly, portions of the top edge 46 at the rear 40 of the outer enclosure 14 are spaced a maximum distance from the bottom edge 30, whereas portions of the top edge 46 of the side wall 42 near the front 34 are spaced a minimum distance from the bottom edge 30.

Portions of the side wall 42 at the front 34 of the outer enclosure 14 are further characterized by a lid recess 48. The lid recess 48 includes linear vertical side edges 50 and 52 that extend downwardly from the top edge 46 and a concave upwardly facing edge 54 that extends between the linear side edges 50 and 52. The concave upwardly facing edge 54 is symmetrical with the valley in the sinusoidal step 44 at the front 34 of the outer enclosure 14. This symmetry provides aesthetic appeal and also functions to target the user's attention at the proper location on the waste container assembly 10 for depositing trash.

The cover 26 of the outer enclosure 14 is further characterized by a top rear wall 56 that extends upwardly and forwardly from the top edge 46 of the side wall 42 across a region extending from the sides 36 and 38 and the rear 40 of the outer enclosure 14. The top rear wall 56 is concave from side-to-side and slightly concave from front-to-rear. Additionally, the top rear wall 56 terminates at a boundary edge 58 which is rearwardly of a plane passing vertically and symmetrically through the sides 36 and 38 of the outer enclosure 14. Thus, the top rear wall 56 effectively defines a sector of an ellipsoid.

The cover 26 of the outer enclosure 14 is further characterized by left and right top front walls 60 and 62. The left and right top front walls 60 and 62 are partly defined by portions of the top edge 46 of the side wall 42 that extend from the left and right respective sides 36 and 38 toward the front 34 of the outer enclosure 14. Additionally, the left top front wall 60 is defined further by a left inner side edge 64 that extends linearly rearwardly from the left side edge 50 of the front lid recess 48. Similarly, the right top front wall 62 is defined partly by a right side edge 66 that extends rearwardly from the right side edge 52 of the lid recess 48. The top front walls 60 and 62 slope downwardly at locations further from the extreme sides 36 and 38 of the outer enclosure 14.

Figure 5:
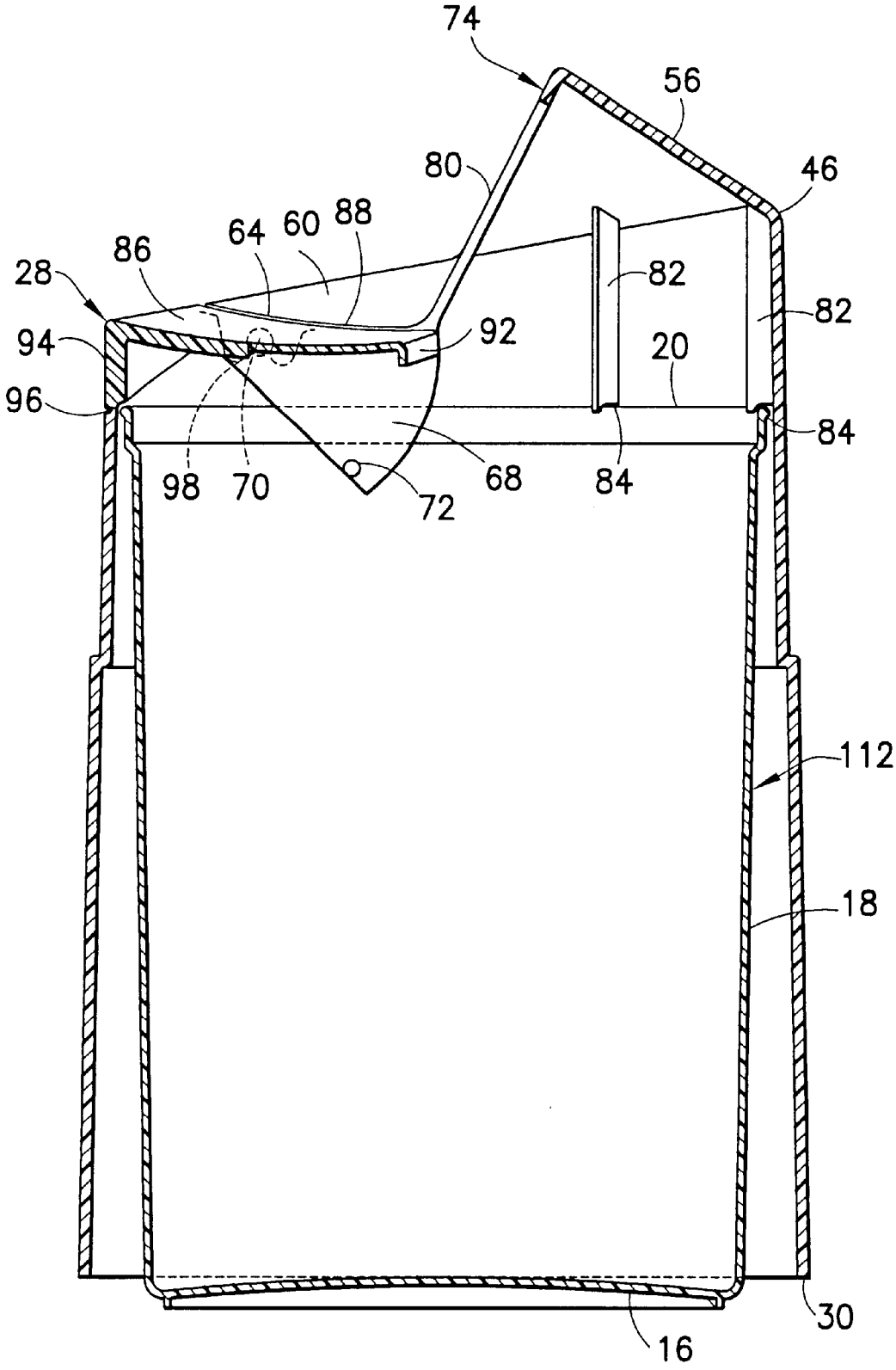
FIG. 5 is a cross-sectional view taken along line 5—5 in FIG. 3.
Figure 5A:
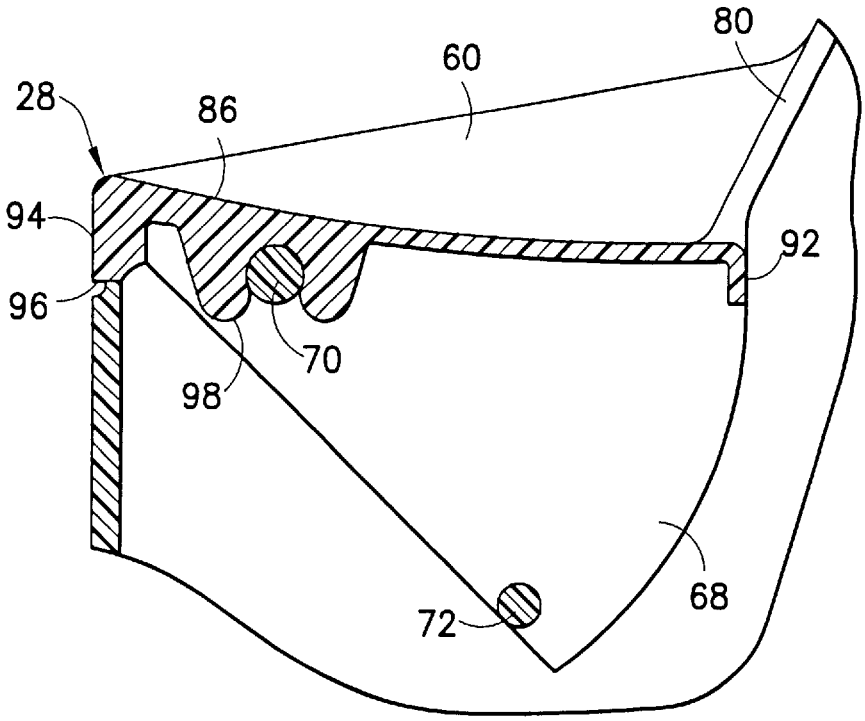
Figure 6:
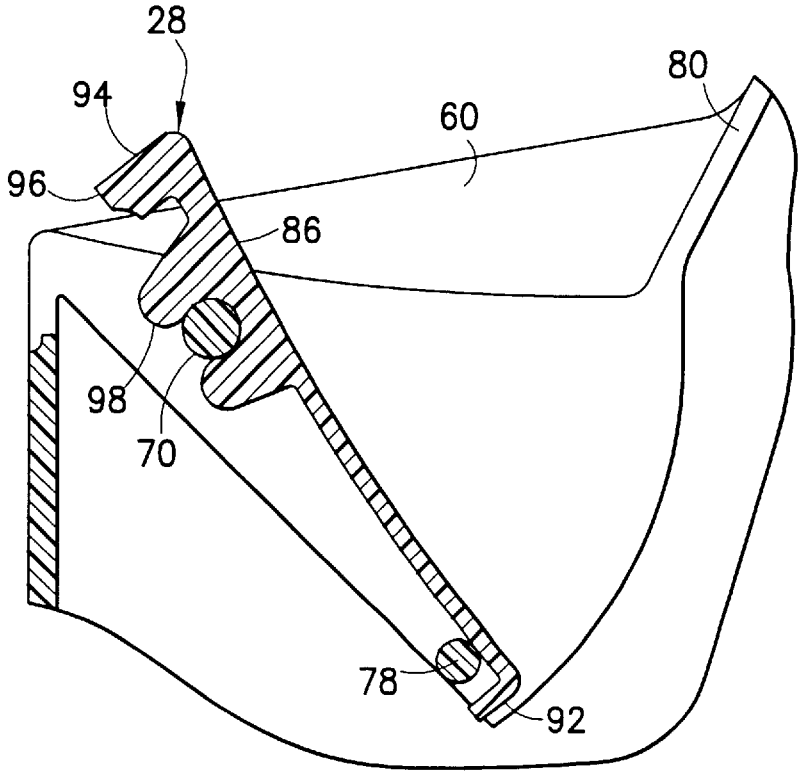
FIG. 6 is a cross-sectional view similar to FIG. 5 but showing only the upper portion of the assembly with the lid in the open condition.
Figure 7:
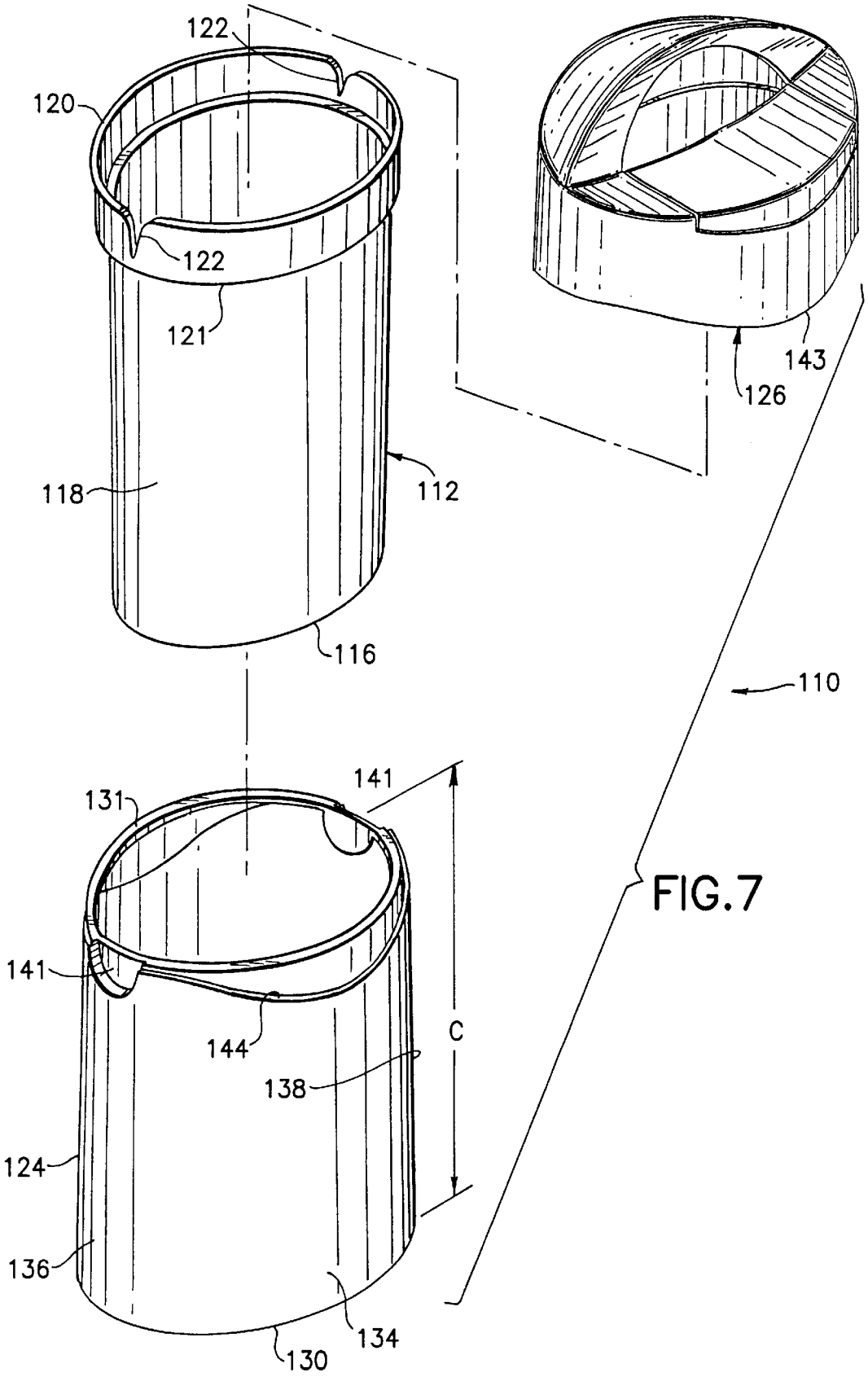
FIG. 7 is an exploded perspective view of a trash can assembly in accordance with a second embodiment of the invention.

Hinge support walls 68 extend vertically downwardly from the inner side edges 64 and 66 of the respective top front walls 60 and 62, as shown most clearly in FIG. 5. The hinge support walls 68 are formed with hinge pins 70 and with stop pins 72.

A connecting wall 74 extends downwardly and forwardly from the boundary edge 58 at the top 32 of the outer enclosure 14. The connecting wall 74 intersects the left top front wall 60 at intersection 76 and intersects the right top front wall 62 at intersection 78. The connecting wall 74 is further characterized by a concave arcuate opening edge 80 that extends between the inner side edges 64 and 66 of the left and right top front walls 60 and 62 respectively.

The outer enclosure 14 is further characterized by vertically aligned inner support walls 82 that extend inwardly from the side wall 42. The inner support walls 82 include a notched bottom supporting edges 84 which are disposed on a common plane that is aligned parallel to the bottom edge 30 of the peripheral skirt 24. Additionally, the bottom edges 84 of the support walls 82 are spaced from the bottom edge 30 of the peripheral skirt 24 by a distance "b" that is slightly less than the height "a" of the inner can 12. The support walls 82 extend sufficiently inwardly to ensure engagement on the top edge 20 of the inner can 12. Thus, the support walls 82 support the outer enclosure 14 with the bottom edge 30 spaced slightly above the floor or other surface on which the bottom 16 on the inner can 12 is supported. This configuration ensures that the weight of the outer enclosure 14 will engage portions of a trash can liner that drape over the top edge 20 of the inner can 12 for preventing the trash can liner from falling into the inner can 12.

The lid 28 includes a top wall 86 with parallel left and right side edges 88 and 90 that fit between the inner side edges 64 and 66 of the respective left and right top front walls 60 and 62. The top wall 86 further includes a rear edge 92 that connects the side edges 88 and 90. The rear edge 92 defines a continuous extension of the intersections 76 and 78 when the lid 28 is mounted properly on the cover 26. The top wall 86 of the lid 28 is concave from side-to-side and is configured such that the top wall 86 of the lid 28 and the top front walls 60 and 62 define a continuous concave surface in front of the connecting wall 74.

The lid 86 further includes a front wall 94 that extends downwardly from the top wall 86 and fits closely into the lid recess 48. The front wall 94 of the lid 28 is convex and continuous with portions of the side wall 42 of the cover 26 at the front 34 of the outer enclosure 14. The front wall 94 includes a bottom edge 96 configured to abut the upwardly facing edge 54 of the lid recess 48 as shown most clearly in FIG. 5.

The lid 28 is characterized further by hinge pin mounts 98 that are dimensioned to mount pivotally on the hinge pins 70 of the cover 26. Thus, the lid 28 is capable of limited hinged movement relative to the cover 26. The limitations on this pivotal movement are provided by the engagement between the bottom edge 96 of the front wall 94 of the lid 28 with the upwardly facing edge 54 of the lid recess 48. Additionally, the stop pins 72 on the inner side wall 68 limit the movement of the rear edge 92 of the lid 28 downwardly into the inner can 12.

As shown most clearly in FIG. 5, the hinge pin 70 and the hinge pin mount 98 are closer to the front wall 94 of the lid 28 than to the rear edge 92 thereof. This relative position enables a very large opening for depositing trash into the waste container assembly 10. However, FIG. 5 also shows that portions of the top wall 86 of the lid 28 between the hinge pin mount 98 and the rear edge 92 are thinner than portions forwardly of the hinge pin mount 98. Furthermore, the front wall 94 also contributes to the mass of the lid 28 forwardly of the hinge pin mounts 98. These relative thicknesses and dimensions are selected carefully to ensure that the mass of the lid 28 forwardly of the hinge pin mounts 98 exceeds the mass of the lid 28 rearwardly of the hinge pin mounts 98. As a result, the lid 28 is gravitationally biased toward the closed position shown in FIG. 5 and is precisely in an alignment where the top wall 86 and front wall 94 of the lid 28 align with adjacent structural elements on the cover 26 to define a smooth continuous top and front surface. However, the relative masses forwardly and rearwardly of the hinge pin mounts 98 are very close to one another. Hence, a minor force on the top wall 86 near the rear edge 92 will cause the lid 28 to swing easily into the open position for depositing trash into the inner can 12.

The waste container assembly 10 is used by initially lifting the outer enclosure 14 from the inner can 12. A plastic waste can liner then is placed in the inner can 12 and the open edges of the waste can liner are draped over the top edge 20 of the inner can 12. Portions of the waste can liner adjacent its open edges may be urged into the V-shaped notches 22 in the top edge 20 for securely but releasably holding the trash can liner and preventing the trash can liner from collapsing into the inner can 12. The outer enclosure 14 then is telescoped over the inner can 12 and the trash can liner therein. This telescoping movement terminates when the bottom edges 84 of the inner support walls 82 are supported on the top edge 20 of the inner can 12. This support further helps to prevent a collapsing of the trash can liner into the inner can 12. In this assembled condition, the open edge of the waste can liner is completely concealed from view by the outer enclosure 14. Furthermore, the lid 28 and the angular alignment of the connecting wall 74 and the positioning of the opening 80 therein substantially obscures all view of the contents of the inner can 12.

The waste container assembly 10 may be used by merely depositing an item of waste onto the top wall 86 of the lid 28 at any location a significant distance rearwardly of the hinge pins 70. This downward force caused by the object that is being discarded will cause the rear edge 92 of the lid 28 to pivot downwardly. In view of the forward position of the hinge pin supports 98 a relatively wide opening for receiving trash is ensured. This wide opening is enhanced by the opening 80 in the connecting wall 74. Users of the assembly will be guided toward the rear edge 92 of the lid 28 by the presence of the opening 80 and by the unique arcuate configurations of the intersecting surfaces of the cover 26. Additionally, the opening movement of the lid 28 is consistent with the depositing direction of the trash. Thus, the user does not have to lift the lid in a first direction and deposit the trash in a second direction. Once the trash is deposited, gravitational forces will cause the lid 28 to swing automatically and completely into the closed position due to the greater mass of the lid 28 forwardly of the hinge pin mounts 98. This greater mass is achieved by the greater thickness of the top wall 86 forwardly of the hinge pin mounts 98 and by the existence of the front wall 94.

Once the trash can liner in the inner can 12 has been filled, the user need merely lift the outer enclosure 14 from the inner can 12. The open edge regions of the waste can liner then are collected and secured, and the closed waste can liner is discarded in a conventional manner. A new waste can liner then can be positioned in the inner can as described above.

FIGS. 7–10 show a waste container assembly 110 that is intended for a greater volume of trash. As a result, there are a few minor differences to facilitate assembly and disassembly and to facilitate insertion and removal of waste can liners.

As in the first embodiment, the waste container assembly 110 includes an inner can 112 and an outer enclosure 114. The inner can 112 includes an oval bottom wall 116 and an oval tubular side wall 118 that extends upwardly to a top edge 120. However, portions of the side wall 118 in proximity to the top edge 120 are enlarged outwardly to define a step 121. Portions of the side wall 118 adjacent the top edge 120 further are provided with V-shaped notches 122 for gripping a trash can liner.

The outer enclosure 114 includes a peripheral skirt 124 and a cover 126 substantially as described above with respect to the first embodiment. Additionally, the cover 126 is formed with a lid 128. Substantially the entire cover 126 and the lid 128 are identical to the cover 26 and lid 28 described and illustrated above. Hence, a detailed description of those identical components is omitted herein. One significant difference between the cover 126 of the second embodiment and the cover 26 of the first embodiment is the absence of internal support walls on the cover 126 that would correspond to the internal support walls 82 on the cover 26. Additionally, the cover 126 and the peripheral skirt 124 are formed separately from one another, as shown most clearly in FIGS. 7 and 8. This separate construction is not immediately apparent on the assembled waste container assembly 110, and on an initial inspection, the waste container assembly 110 merely appears to be a larger version of the waste container assembly 10.

The peripheral skirt 124 includes an open bottom 130 and an open top 131. The edges defined by the open bottom and top 130 and 131 are substantially parallel to one another. Additionally, the internal cross-sectional dimensions at the open top 131 are slightly greater than the outside cross-sectional dimensions of the side wall 118 of the inner can 112 at locations below the step 121. However, the outside cross-sectional dimensions of the inner can 112 at locations above the step 121 exceed the inside cross-sectional dimensions at the open top 131 of the peripheral skirt 124. Hence, the inner can 112 can be nested into the top of the peripheral skirt 124, and the step 121 will be supported on the edge defined by the open top 131 of the peripheral skirt 124. The peripheral skirt 124 defines a height "c" which is slightly greater than the vertical distance between the bottom wall 116 and the step 121 of the inner can 112. Hence, the bottom wall 116 of the inner can will be supported slightly above the floor or other surface on which the open bottom 130 of the peripheral skirt 124 is supported.

The peripheral skirt has a front 134, sides 136 and 138 and a rear 140. Hand grip recesses 141 extend into the sides 136 and 138 at locations adjacent the open top 131.

Portions of the peripheral skirt 124 adjacent the open top 131 are cross-sectionally slightly smaller than portions of the peripheral skirt extending upwardly from the open bottom 130. These cross-sectional differences occur at a sinusoidal step 144 in proximity to the open top 131. The sinusoidal step 144 resembles the sinusoidal step 44 on the outer enclosure 14 of the first embodiment. The hand grip recesses 141 are adjacent to but beneath both the open top 131 and beneath portions of the sinusoidal step 144 at the sides 136 and 138.

The cover 126 includes a side wall 142 that is dimensioned to telescope over both portions of the inner can 112 adjacent the open top 120 and over the cross-sectionally small portions of the peripheral skirt 124 between the top edge 131 and the sinusoidal step 144. Additionally, side wall 142 includes a sinusoidally generated bottom edge 143 that is dimensioned to nest with a sinusoidal step 144.

Figure 8:
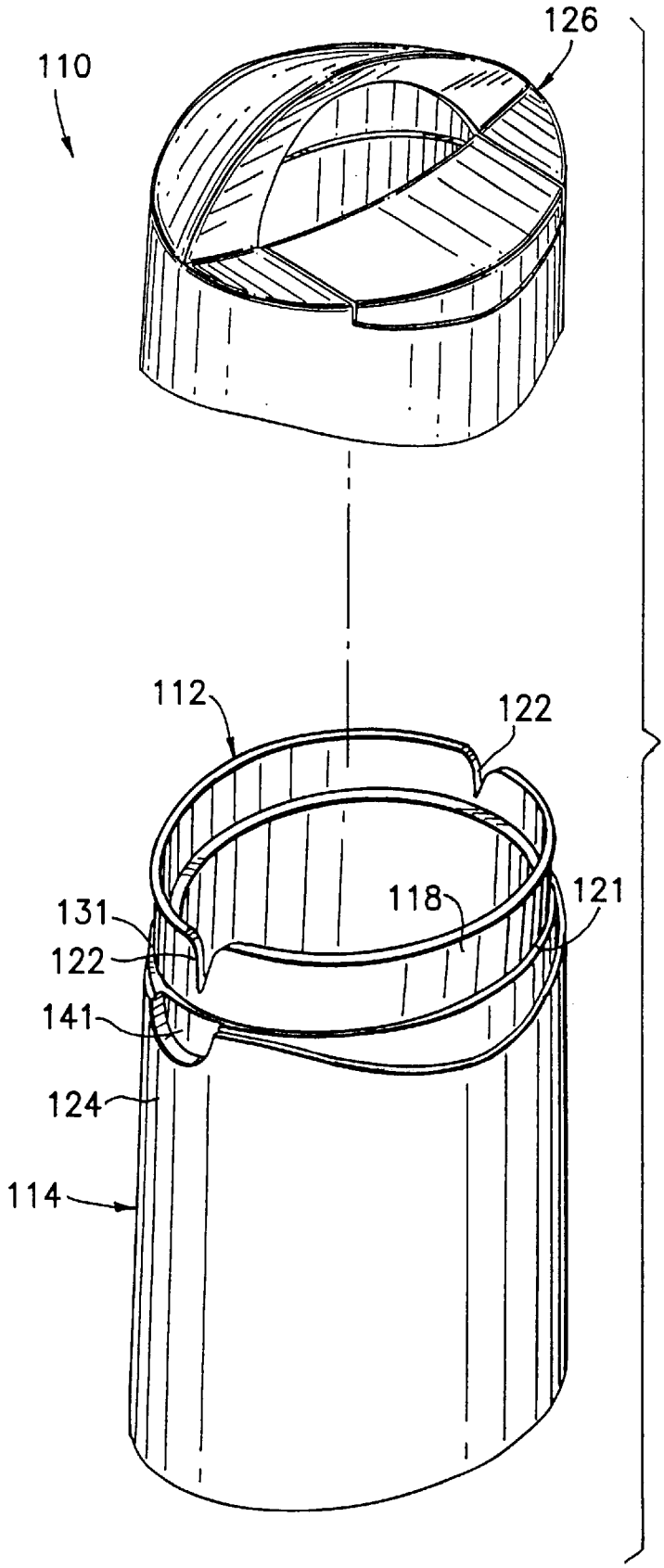
FIG. 8 is an exploded perspective view of the trash can assembly of FIG. 7 in a partly assembled condition.
Figure 9:
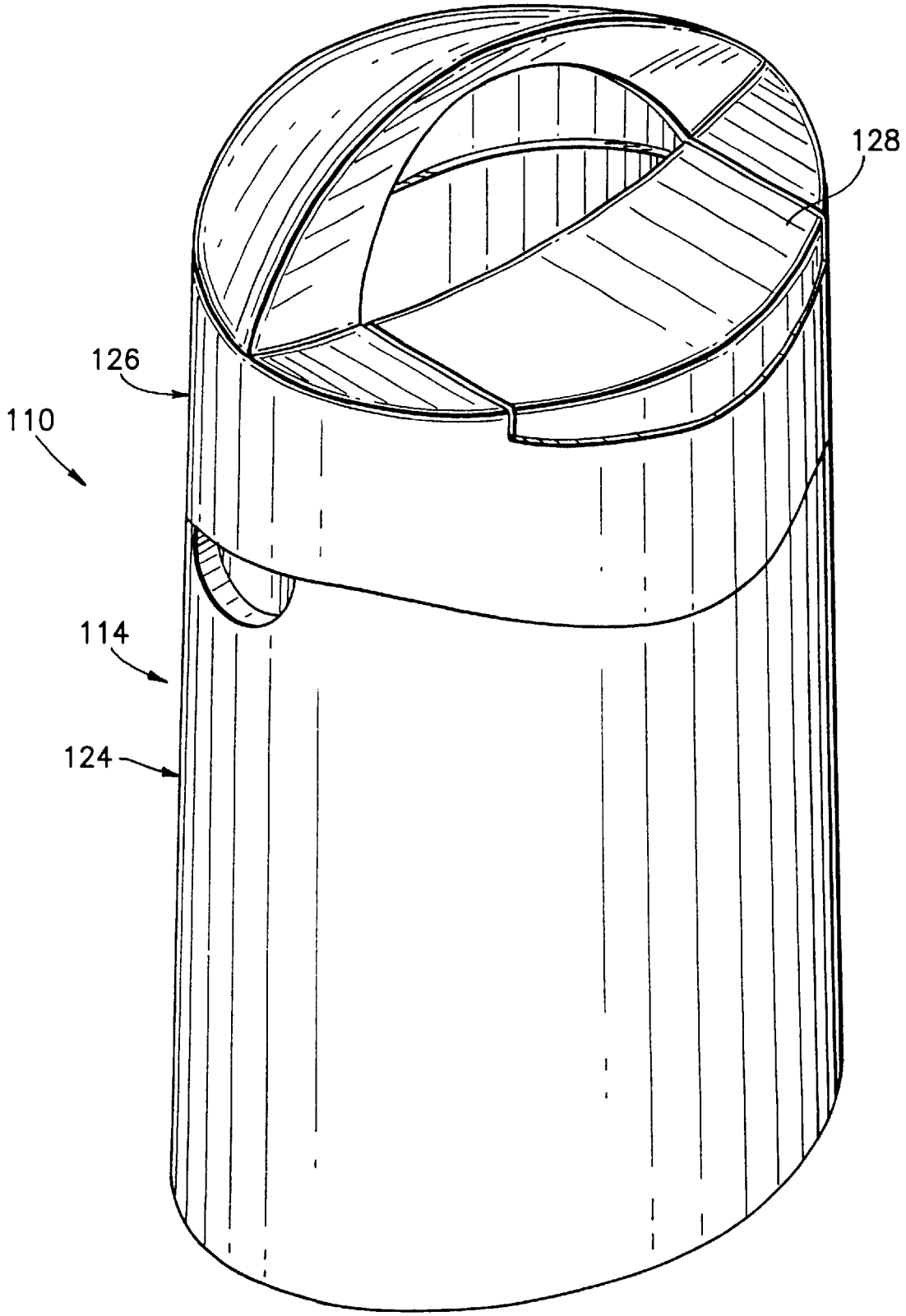
FIG. 9 is a perspective view showing the trash can assembly of FIGS. 7 and 8 in a fully assembled condition.
Figure 10:
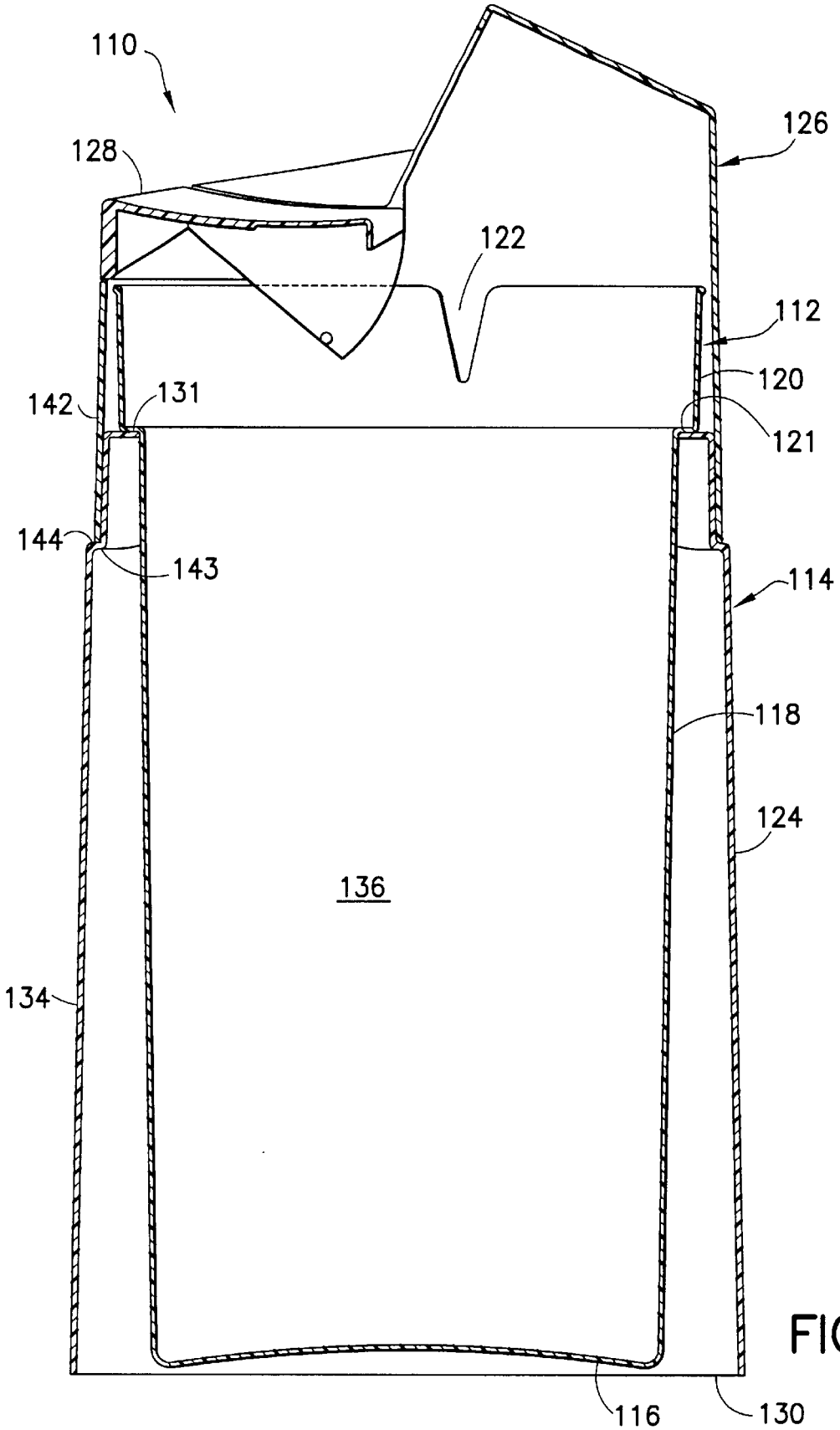
FIG. 10 is a cross-sectional view similar to FIG. 5, but showing the trash can assembly of FIGS. 7–9.

The waste container assembly 110 is used by placing a waste can liner in the inner can 12 and folding the open edges of the waste can liner over the open top 120 of the inner can 12. Portions of the plastic of the waste can liner can be releasably engaged in the V-shaped notches 122 to prevent the waste can liner from collapsing into the inner can 112. The inner can 112 with the waste can liner therein then can be telescoped into the open top 131 of the peripheral skirt 124. As shown in FIG. 8, the step 121 in the sidewall 118 of the inner can 112 will seat on the open top 131 of the peripheral skirt 124 and will project slightly over the hand grip recesses 141. Thus, a user can readily grip the step 121 of the inner can 112 at the hand grip recesses 141 for removing the inner can 112 if necessary. The cover 126 then is telescoped over the open top 120 of the inner can and over portions of the open top 131 of the peripheral skirt 124. As shown in FIG. 9, the bottom end 143 of the side wall 142 of the cover 126 will be positioned above the hand grip recesses 141 of the peripheral skirt 124 to facilitate a subsequent removal of the cover 126.

As in the preceding embodiment, the cover 126 conceals portions of the waste can liner folded over the open top 120 of the inner can 112. Thus, the unsightly waste can liner is not viewed from the exterior of the waste container assembly 110. Additionally, the contents of the waste can liner are concealed by the cover 126.

Trash is deposited into the waste receptacle assembly 10 substantially in exactly the manner described with respect to the first embodiment. More particularly, the mass distribution of the lid 128 enables trash to be deposited merely by exerting a slight downward force on the rear edge of the lid 128. The lid 128 then will gravitationally return to the closed position shown in the figures.

The full waste receptacle liner can be removed from the inner can 112 merely by lifting the cover 126 from the peripheral skirt. The open edges of the liner then can be gathered together and the liner can be lifted from the inner can 112. A new liner can be positioned in the inner can 112 with the open top edges folded over the open top 120 of the inner can 112, as described above. Gathered portions of the liner can be secured in the V-shaped notches 122. Finally, the cover 126 can be telescoped over the open top 120 of the inner can 112 and over the open top 131 of the peripheral skirt 124.

While the invention has been described with respect to certain preferred embodiments. It is apparent that various changes can be made without departing from the scope of the invention as defined by the appended claims. For example, the waste receptacle assembly can have cross-sectional shapes other than the preferred oval shape shown herein.

What is claimed is:

1. A waste container assembly comprising:

an inner can having a bottom wall, a peripheral side wall enclosure extending upwardly from the bottom wall and an open top, wherein the inner can has a plurality of V-shaped notches at the open top for releasably gripping a waste can liner; and an outer enclosure having a peripheral skirt with an open bottom, a side wall and a top, a cover with a side wall extending upwardly from the top of the peripheral skirt, the side wall of the cover and the peripheral skirt being dimensioned to telescope over and conceal the inner can and any waste can liner positioned in the inner can, the cover further including at least one top wall for concealing at least a portion of the open top of the inner can, a lid hingedly mounted to the cover for placing trash in the inner can, the lid being mounted to hinges in proximity to the side wall of said cover such that portions of the lid spaced inwardly from the side wall are pivotable downwardly toward the said inner can, the lid being dimensioned relative to said hinge to gravitationally pivot to a closed position.

2. A waste container assembly comprising:

an inner can having a bottom wall, a peripheral side wall enclosure extending upwardly from the bottom wall and an open top; and an outer enclosure having a peripheral skirt with an open bottom, a side wall and a top, a cover with a side wall extending upwardly from the top of the peripheral skirt, the side wall of the cover and the peripheral skirt being dimensioned to telescope over and conceal the inner can and any waste can liner positioned in the inner can, the cover further including at least one top wall for concealing at least a portion of the open top of the inner can, a lid hingedly mounted to the cover for placing trash in the inner can, the lid being mounted to hinges in proximity to the side wall of said cover such that portions of the lid spaced inwardly from the side wall are pivotable downwardly toward the said inner can, the lid being dimensioned relative to said hinge to gravitationally pivot to a closed position, wherein the cover includes a side wall enclosure having a front, a rear and opposite sides, the side wall having an upper edge spaced further from the bottom of the outer enclosure at the back than at the front, a top rear wall extending upwardly and forwardly from the rear of the side wall, the top rear wall being convex from side-to-side and from front-to-rear, spaced apart left and right top front walls extending rearwardly and inwardly from the side wall adjacent the sides and front of the outer enclosure and a connecting wall extending between the top rear wall and the left and right top front walls, the connecting wall including an opening communicating with the space between the left and right top front walls for receiving trash deposited into the inner container, the lid being hingedly mounted between the left and right top front walls.

3. The waste container assembly of claim 2, wherein the left and right top front walls slant downwardly at locations further from the sides of the outer enclosure.

4. The waste container assembly of claim 3, wherein the front of the side wall of the cover includes a lid recess having an upwardly facing edge and parallel left and right side edges extending upwardly from the upwardly facing edge, the left and right top front walls having left and right inner edges aligned respectively with the left and right side edges of the lid recess, the lid being hingedly mounted for movement between the left and right side edges of the lid recess and the left and right inner edges of the respective left and right upper front walls.

5. The waste container assembly of claim 4, wherein the lid includes a top wall disposed between the left and right top front walls of the cover, the top wall of the lid having opposite front and rear edges, a front wall extending downwardly from the top wall of the lid and aligned with the front of the side wall of the cover, hinge mounts being disposed on the top wall of the lid at locations closer to the front wall than to the rear edge of the top wall, the lid being configured such that portions of the lid forwardly of the hinge mounts define a mass greater than portions of the lid rearwardly of the hinge mounts, such that the lid is gravitationally biased into a position where the front wall of the lid abuts the front of the side wall of the cover.

6. The waste container assembly of claim 5, wherein the top wall of the lid is slanted downwardly and rearwardly when the lid is in the closed position.

* * * * *